United States Patent [19]

Wüsthof et al.

[11] 4,139,335

[45] Feb. 13, 1979

[54] ROTARY FLUID DISPLACING APPARATUS OPERABLE AS PUMP OR MOTOR

[75] Inventors: Peter Wüsthof, Lohr; Johann Schneider, Lohr-Wombach, both of Fed. Rep. of Germany

[73] Assignee: G. L. Rexroth GmbH, Lohr, Fed. Rep. of Germany

[21] Appl. No.: 783,337

[22] Filed: Mar. 31, 1977

[30] Foreign Application Priority Data

Apr. 3, 1976 [DE] Fed. Rep. of Germany ..... 2614471

[51] Int. Cl.[2] ..... F04C 29/08

[52] U.S. Cl. ..... 418/61 B

[58] Field of Search ..... 418/61 B; 137/625.21

[56] References Cited

U.S. PATENT DOCUMENTS

| | | | |
|---|---|---|---|
| 3,452,680 | 1/1969 | White, Jr. | 418/61 B |
| 3,601,513 | 8/1971 | White, Jr. | 418/61 B |
| 3,715,175 | 2/1973 | Woodling | 418/61 B |
| 3,887,309 | 6/1975 | Easton | 418/61 B |

*Primary Examiner*—John J. Vrablik

*Assistant Examiner*—Leonard E. Smith

*Attorney, Agent, or Firm*—Michael J. Striker

[57] ABSTRACT

A rotary fluid displacing apparatus operable as pump or motor comprises a housing in which a fluid displacing unit is arranged comprising an annular stator having a plurality of radially inwardly extending teeth and a rotor within the stator and having radially outwardly extending teeth numbering one tooth less than those of the stator, meshing with the teeth of the latter, and forming between the stator and the rotor spaces increasing and decreasing during rotation of the rotor. Flow of fluid into and out of these spaces is controlled by a stationary control plate and a rotary control disc, both of which are formed with a central opening through which a universal-joint shaft extends which, at one end is tiltably connected to a machine shaft mounted in the housing for rotation about a fixed axis. The rotor and the control disc are provided with internal gears meshing with external gear sets on the universal joint shaft to impart to the control disc a rotary and orbiting motion during rotation of the machine shaft.

8 Claims, 8 Drawing Figures

ROTARY FLUID DISPLACING APPARATUS OPERABLE AS PUMP OR MOTOR

Figure 1:
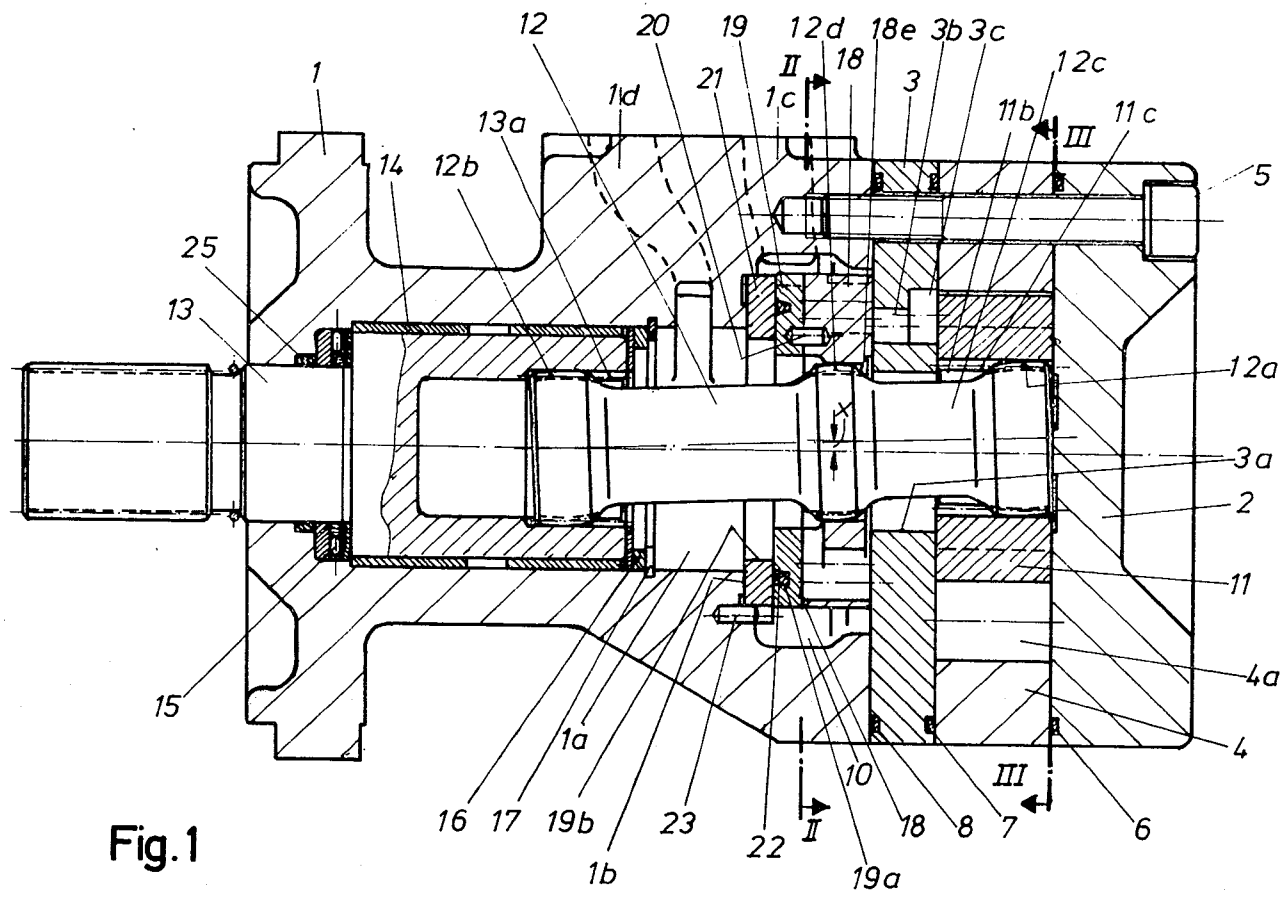

The invention relates to a rotary fluid displacing apparatus especially to a rotary motor having liquid as drive means. In a rotary fluid displacing apparatus the direct connection of the rotary part of the control with the universal joint shaft has, as compared with rotary fluid displacing machines in which the control is coupled by a separate control shaft with the rotor of the displacement unit, the advantage, that besides a high control exactness an essential simplification of the construction of the rotary piston machine will result.

The coupling of the rotary part of the control with the universal joint shaft is carried out in a known manner on the side of the machine shaft facing away from the displacement unit, whereby the universal joint shaft is provided with a corresponding elongation. From this results a relatively large eccentric displacement of the control disk, pendulating connected to the universal joint shaft, and forming the rotary part of the control constructed as rotary valve, relative to the stationary control plate. The thereby resulting displacement movement of the control disk is greater than the eccentric displacement movement of the rotor of the displacement unit, and therewith considerably greater than the rotary movement thereof due to the coupling with the universal joint shaft. By forming the control disk in a suitable manner its eccentric, respectively radial displacement is used besides its strictly rotary movement for the control. From this results besides a high control speed of the control disk a relatively complicated and loss causing introduction and discharge of the working medium to respectively from the displacement spaces of the displacement unit. For the introduction and discharge of the working medium to, respectively from, the displacement spaces of the displacement unit there is necessary, in a known manner, besides the control plate a further control channel plate. In order to avoid this expensive control channel guiding, it is known, to mount the control disk centrally and to drive the latter by means of a tang formed by an elongated end of the universal joint shaft. In this construction of the control, the control disk carries out a rotary movement which corresponds to the comparatively fast movement of the universal joint shaft about the machine shaft axis in the region of the motor of the displacement unit. A disadvantage of this concept is the high rotary movement of the control disk and the difficulty to seal the gap at the control disk, which is especially important in rotary piston machines operating at high pressure.

The object of the invention resides in the provision of a rotary piston machine which especially assures, due to small control speeds of the rotary part of the control, the use of the rotary piston machine for highest pressures and relatively high number of revolutions and which, in addition, will result in a compact construction favoring use of high pressures.

This will be obtained according the invention by the characterizing features of claim 1. In rotary piston machines with a control driven by separate universal joint shaft, it is already known to arrange the control, which is constructed as rotary valve, between the displacement unit and the machine shaft. In this case it is however necessary, to construct the universal joint shaft, which transmits the turning moment, as hollow shaft for the reception of the control shaft which transmits the rotary movement onto the rotary part of the control. In addition the universal joint shaft which transmits the turning moment has to be provided with radial bores for the insertion of a transverse bolt as coupling element between the rotary part of the control and the control shaft provided for the control. This will result not only in a rather complicated construction of the rotary piston machine, but in addition there will also result a non-uniform control movement and weakening of the universal joint shaft which transmits the turning moment. Such a rotary piston machine is therefore only usable for small pressures and therewith only for the transmission of small turning moments.

Further characteristics of the invention will result from the dependent claims.

Figure 2:
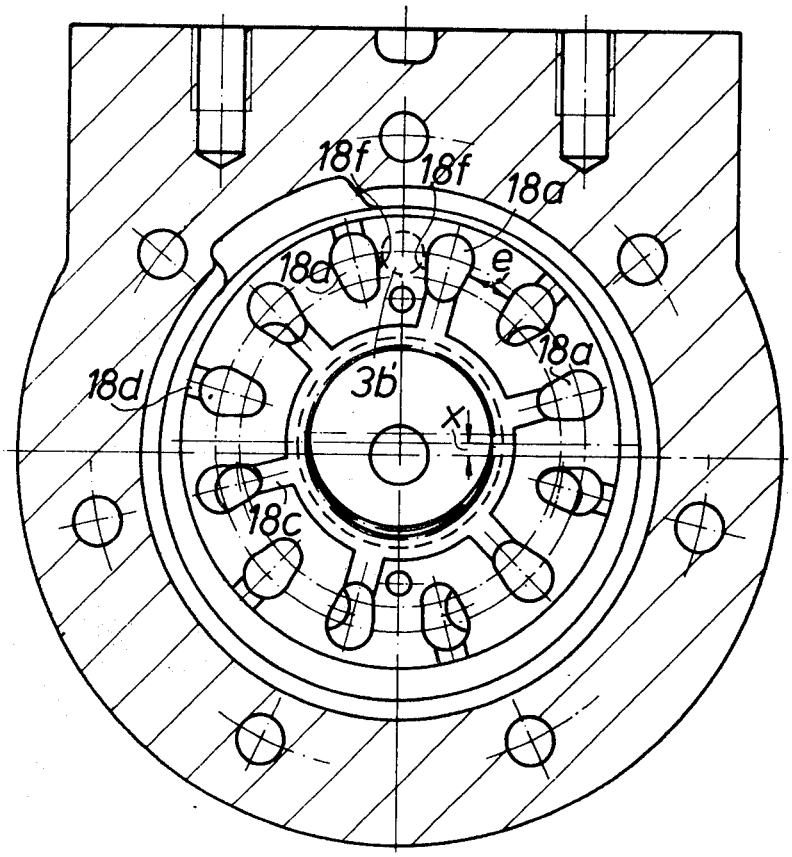
Figure 3:
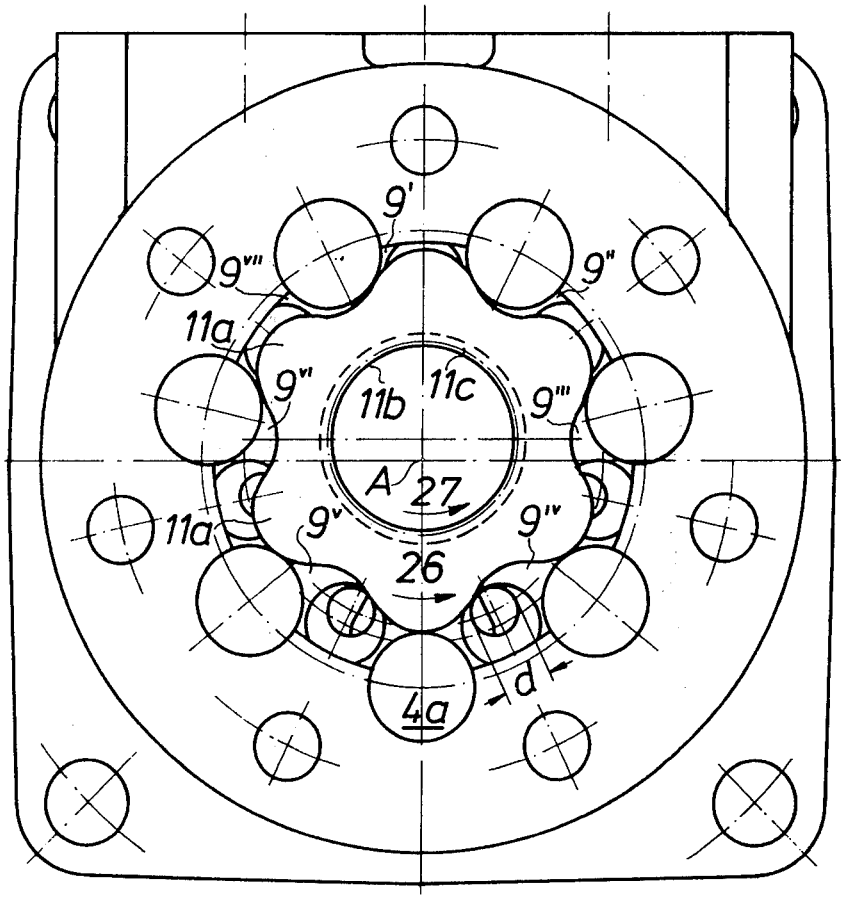
Figure 4:
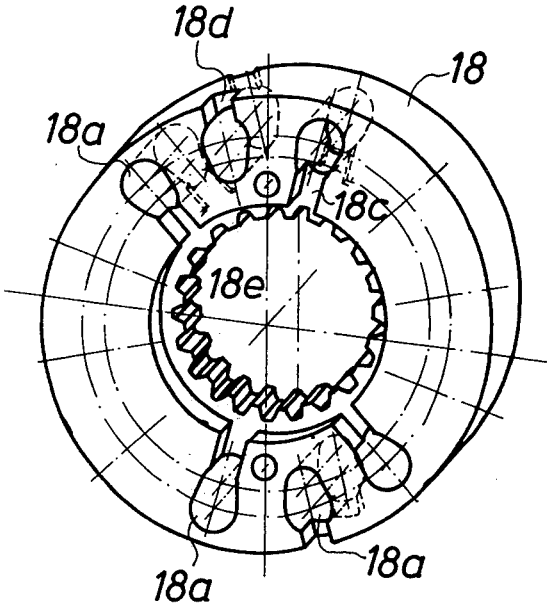
Figure 5:
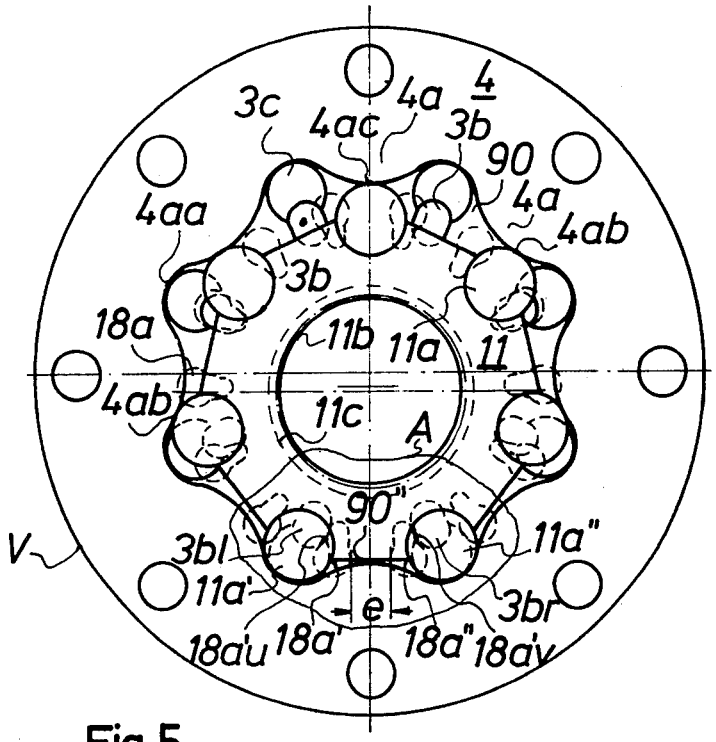
Figure 6:
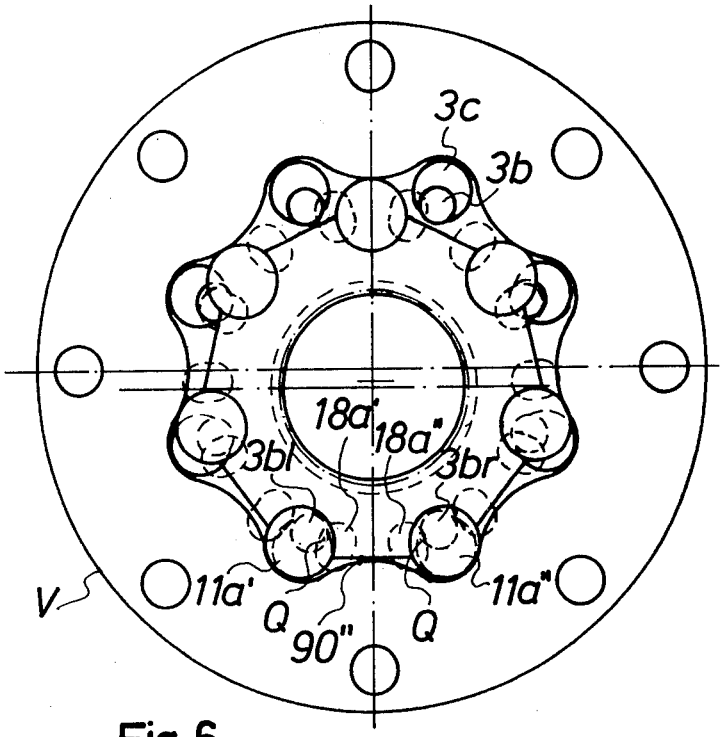
Figure 7:
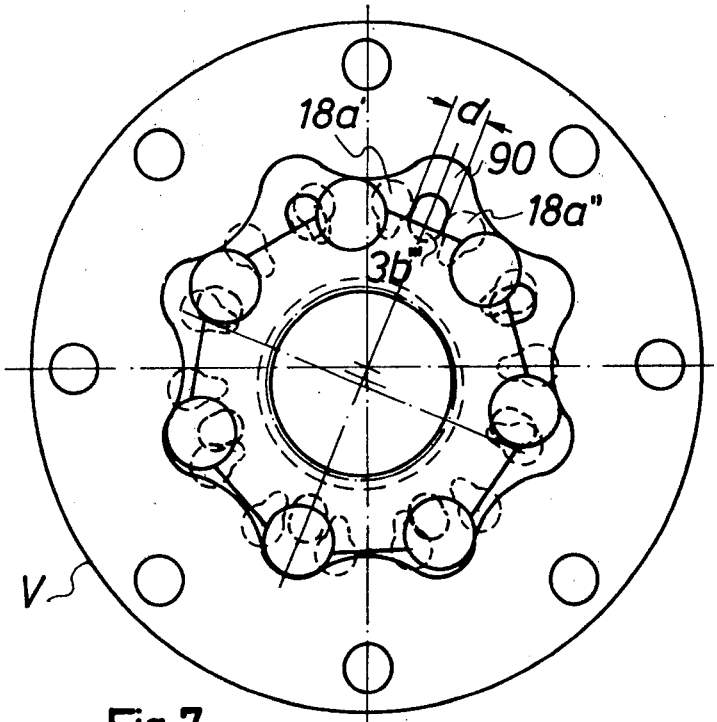
Figure 8:
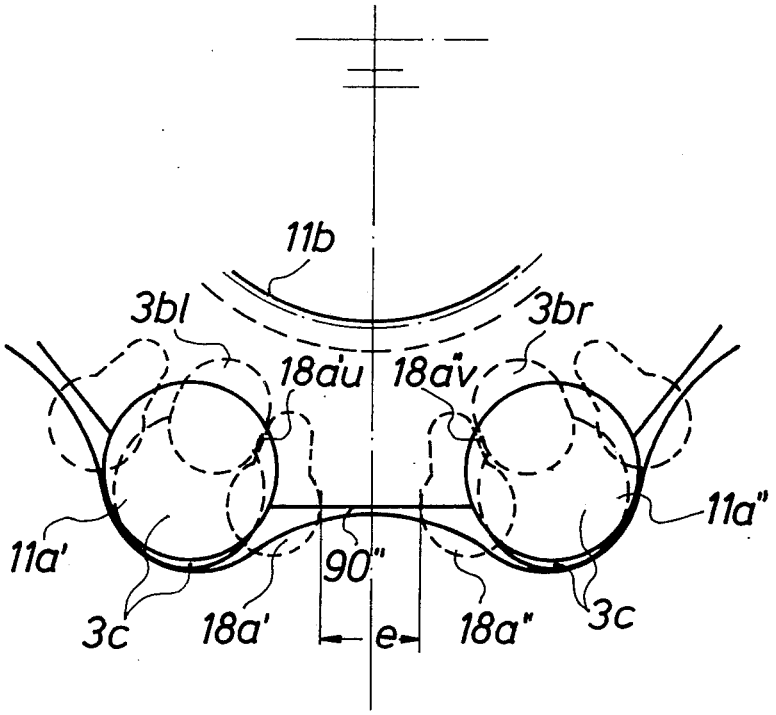

One construction according to the invention is illustrated by way of an example in the drawing. There are shown:

FIG. 1 is an axial cross-section of a rotary piston machine operating as motor according the invention, FIG. 2 is a cross-section along the line II—II of FIG. 1, FIG. 3 is a cross-section along the line III—III of FIG. 1, FIG. 4 is a perspective view of the control disk, FIG. 5 is a cross-section along the line III—III of FIG. 1, whereby the displacement unit comprises a rotor, the teeth of which are formed by rolls, FIG. 6 shows the same cross-section and rotor as FIG. 5, however with a position of the rotor for the smallest volume, FIG. 7 is a cross-section through the rotor as in FIG. 5, however with a position of the rotor for the maximum volume and FIG. 8 is an enlarged view of the portion A in FIG. 5.

In FIG. 1 the pump housing is designated with the reference numeral 1 and the pump cover with the reference numeral 2. The reference numeral 3 designates the control plate and the reference numeral 4 the internally geared stator. The housing cover 2 together with the stator 4 as well as the control plate are fastened to the pump housing 1 by means of screws 5. The sealing rings 6, 7 and 8 assure a sealed closure of the displacement spaces 9 (FIG. 3) as well as of the annular housing space 10 towards the outside. The externally geared rotor 11 which has one tooth less than the internally geared stator 4 forms together with the stator the displacement unit V (FIG. 3). The displacement spaces 9 of the displacement unit V are located between two teeth 4*a*, which in the present embodiment are arranged as rolls in corresponding cutouts of the stator 4 and the displacement spaces are delimited towards the interior by the teeth 11*a* of the rotor 11. The rotor is provided in a bore 11*b* therethrough with an internal gearing 11*c* which engages the curved gearing 12*a* of the universal joint shaft 12, whereby the universal joint shaft is coupled turnably and tiltably with the rotor. The other end of the universal joint shaft 12 is provided with the same curved gearing 12*b* and is connected with the internal gearing 13*a* of the outwardly extending machine shaft 13 tiltable and turnable therewith. The machine shaft 13 is in the region of its internal gearing 13*a* provided with a larger diameter and mounted in slide bearings 14. In axial direction the machine shaft abuts against an axial bearing 15. The machine shaft is axially fixed in direction towards the housing space 1*a*, through which the universal joint shaft 12 extends, by means of a bearing ring 16 in connection with a snap ring inserted in the pump housing. A further curved gearing 12*d* is provided at the rotor side half 12*c* of the universal joint shaft, which is in tiltable, respectively pendulating rotary connection with an internal gearing 18*e* of the control disk 18. The curved gearing 12*d* of the universal joint shaft 12 is at least similar to curved gearings 12*a*, respectively 12*b* provided at the ends of the shaft so that at the same pitch circle diameter the possibility of mounting of the control disk 18 is assured. By arranging the curved gearing 12*d* and therewith the position of the control disk 18 in the region of the rotor side half 12*c* of the universal joint shaft 12, the torsion occurring during transmission of the turning moment from the rotor 11 onto the machine shaft 13 is in this region small and therewith also the control error depending thereon of the rotary valve formed by the control disk 18 and the control plate 3. A sealing plate 19 is arranged on the side 18*b* of the control disk 18 which faces away from the control plate and connected thereto for rotation by means of a pin 20. The sealing plate 19 sealingly abuts against a support plate 21 by means of a sealing ring 22 inserted in an annular groove 19*a* and the support plate 21 in turn abuts in a fluid tight manner against the housing flange 1*b*. The support plate is secured against rotation by a dowel pin 23. The annular housing space 10, which is delimited toward the interior by the control disk 18, the sealing plate 19 as well as by the support plate 21, is connected with a housing channel 1*c*, which forms one connection for the working medium of the rotary piston machine. The pump space 1*a* through which the universal joint shaft 12 extends communicates with the housing channel 1*d*, which forms the other connection for the working medium.

The control disk 18 is provided with circumferentially uniformly displaced control openings 18*a* therethrough, which on both sides of the control disk are connected in alternating sequence with radially inwardly, respectively radially outwardly extending cutouts 18*c*, respectively 18*d*. The radially inwardly extending cutouts 18*c* (FIGS. 2 and 4) connect the respective control openings 18*a* with the housing space 1*a* and the radially outwardly extending cutouts 18*d* connect the respective control openings with the annular space 10. Since the cutouts are provided on both sides of the control disk the latter is hydraulically balanced, that is there are no free axial pressure forces acting on the control disk. The cutouts 18*c* and 18*d* provided on the side 18*b* of the control disk, which face away from the control plate 3, are constructed deeper than the cutouts provided on the control disk facing the control plate, since the first-mentioned one are destined for the inlet, respectively outlet, of the working medium from, respectively to, the control openings of the control disk.

The control openings 18*a* of the control disk 18 cooperate with the control passages 3*b* of the control plate 3, whereby depending on the turned position of the universal joint shaft 12 and therewith of the control disk 18, these control passages 3*b* are connected either with the control openings 18*a* of the control disk, which through the cutouts 18*a* communicate with the pump space 1*a*, or over the cutouts 18*d* with the annular space 10. The control passages 3*b* are provided in the region of the displacing unit V with a larger cross-section 3*c* so that in each position of the rotor 11 the respective displacement space 9 remains positively in connection with the control passage 3*b*.

In order to assure that the shaft seal 25 has not to seal the shaft passage under pressure, it is advantageous to connect the housing space 1*a* over the housing connecting channel 1*d* with a, not illustrated, return conduit and the annular space over the housing channel 1*c* with the pressure, respectively the pump conduit.

The distance e between facing edges 18*f* (FIG. 2) of adjacent control openings 18*a* of the control disk is over the total radial extension of the control openings equal or larger than the in circumferential direction extending distance d of the control passages 3*b* of the control plate 3. This will assure that during the change of the position of the control openings of the control disk, during the turning movement of the latter, no short-circuit will occur between the one control opening which is in communication with the pump space 10 and the following control opening which is in communication with the housing space 1*a* over the control passages 3*b* of the control plate, which will also prevent any reduction of the efficiency of the machine. The control openings 18*a* extend in radial direction through a distance which is greater than the corresponding extension of the control passage 3*b* of the control plate 3 by an amount equal to the eccentric displacement x of the control disk 18 with respect to the control plate 3. In the position of the control disk 18 as shown in FIG. 2, the control passage 3*b*' is located exactly between two neighboring control openings 18*a* so that the control space 9' which is in communication with this control passage communicates neither with the annular space 10, which is under the pressure of the working medium, nor with the housing space 1*a*, which is connected with the return conduit. The displacement spaces 9'', 9''' and $9^{IV}$, however, are in communication with the control openings which communicate with the annular space 1*a*. The oppositely located displacement spaces $9^{V}$, $9^{VI}$, $9^{VII}$ communicate with the control openings of the control disk which are connected with the housing space 10. From this will result a turning moment on the rotor 11 in the direction of the arrow 26. The therewith resulting rolling moment of the teeth 11*a* of the rotor on the teeth 4*a* of the stator results in an eccentric movement of the center point of the rotor about the axis A of the stator. During turning of the center point of the rotor about the axis A of the stator through 360°, one rotor teeth moves through one pitch. The universal joint shaft 12 correspondingly carries out a movement in the direction of the arrow 27 which corresponds to the movement of the rotor through one pitch. This rotary movement of the universal joint shaft 12 is transmitted to the machine shaft 13. Therefore six eccentric movements of the center point of the rotor about the axis A of the stator are necessary in order for the machine shaft to make one revolution about its axis. At the same time the rotary movement of the universal joint shaft is also transmitted to the control disk 18. Therefore, while the rotor turns through one pitch, the universal joint shaft and therewith the control disk turns through an angle which corresponds to this pitch. This coupling of the movements will assure that proper control connections are always provided between the individual displacement spaces and the housing space 1*a*, respectively 10 so that the operating cycle will always remain the same. The inlet and discharge of the working medium into, respectively from, the displacement unit occurs over the control openings of the control disk in connection with the control passages in the control plate parallel to the axis, that is without large deflections so that only small flow losses will occur. In addition the control openings and the control passages can be manufactured in a simple manner.

In the construction of the displacement unit V according to FIGS. 5, 6, 7 and 8, the teeth 11*a* of the rotor 11 which are formed by rolls are, depending on the turned position of the rotor, in sealing abutment with the dedendum 4*aa*, the tooth flanks 4*ab* or the addendum 4*ac* of the teeth of the stator. The displacement spaces 90 of this displacement unit are therefore delimited by adjacent teeth 11*a* of the rotor.

In FIG. 5 the rotor 11 has a turned position in which the displacement space 19", which is delimited by the rolls 11*a*', 11*a*", has its smallest volume. This displacement space 19" is laterally limited by the control openings 3*bl*, 3*br* of the stationary control plate 3, whereby the control openings 18*a*', 18*a*" of the control disk 18 rotating with the rotor, which can be brought in operative connection with these control openings in this rotary position of the rotor, are located, with the outer radial direction extending faces 18*a*'*u*, 18*a*"*v* of the two control openings 18*a*', 18*a*" of the control disk, between the control openings 3*bl*, 3*br* of the control plate (FIG. 8). In this way it is positively avoided that the one control opening 18*a*', which is impinged by the inlet pressure, communicates with the other control opening 18*a*", which is impinged by the outlet pressure over the control openings 3*bl*, 3*br* and the enlarged regions 3*c* thereof at the rotor side of the control plate or with the displacement space 19", to thereby short-circuit the inlet side with the outlet side of the hydromachine, as would be the case at an overlapping of the two control openings which are brought into operative connection in the shown rotary position of the rotor in which the smallest volume of the respective displacement space is obtained.

In FIG. 6 the control openings 3*bl*, 3*br* overlap over the region Q with the control openings 18*a*', 18*a*" of the control disk during the changeover phase of the smallest volume of the displacement space 90". This overlapping has however no detrimental influence in the present case since the control openings 3*bl*, 3*br* including the enlarged cross-sections 3*c* on the rotor side of the control plate are closed by the rolls 11*a*', 11*a*" of the rotor so that no connection exists between the inlet side to the outflow side of the hydromachine over the displacement space 90". To use the rolls forming the teeth of the rotor for the control of the smallest volume, has the advantage of a simple construction of the control openings of the control plate and the control disk which cooperate with each other. The construction of the control openings has in this case to be harmonized for the changeover of the largest volume of the displacement spaces according to FIG. 7. Thereby attention has to be given only that the control openings 3*b* of the control plate, which communicate with the displacement spaces 90, have on the side of the control disk 11 such a dimension d in the circumferential direction of the displacement unit V, that they are located, prior to starting of the changeover procedure of the largest volume, between the two with each other coordinated control openings 18*a*', 18*a*", so that no fluid connection exists between the control opening of the control plate and the two control openings of the control disk. The dimension d in circumferential direction of the control opening 3*b*''' *of the control plate has therefore to be equal or smaller than the distance e (FIG. 8) between the two adjacent control openings 18a'*, 18*a*" of the control disk.

We claim:

1. A rotary fluid displacing apparatus operable as pump or motor comprising housing means; a fluid displacing unit within said housing means and comprising an annular stator stationarily mounted in said housing means and having a plurality of inwardly extending teeth and a rotor within said stator and having radially outwardly extending teeth numbering one tooth less than those of said stator and meshing with said teeth of the latter, said rotor being provided with a central opening therethrough; a machine shaft mounted in said housing means for rotation about a fixed axis and having an end portion projecting beyond said housing means and an opposite tubular end portion; a universal-joint shaft connected at opposite ends respectively to said machine shaft and said rotor for rotation therewith and tiltable relative thereto; and fluid control means comprising a stationary control plate and a rotary control disc both formed with central openings therethrough and both located between said machine shaft and said displacing unit, said universal joint shaft extending through the central openings in said control plate and said control disc; said tubular end portion of said machine shaft, said central opening in said control disc, and said central opening in said rotor being provided with radially inwardly projecting gear teeth and said universal joint shaft being provided with three sets of radially outwardly extending gear teeth curved in axial direction and respectively meshing with said gear teeth at said tubular end portion of said machine shaft, the gear teeth at said central opening of said control disc and the gear teeth at said central opening of said rotor, thereby coupling said universal joint shaft to said control disc to impart to the latter a rotary and orbiting movement during rotation of said machine shaft, the pitch circle diameter of the set of curved gear teeth on said universal joint shaft meshing with said gear teeth at the central opening of said control disc being larger than the pitch circle diameter of the other two sets of gear teeth.

2. A rotary fluid displacing apparatus operable as pump or motor comprising housing means; a fluid displacing unit within said housing means comprising an annular stator stationarily mounted in said housing means and having a plurality of radially inwardly extending teeth and a rotor within said stator and having radially outwardly extending teeth meshing with said teeth of the stator, said rotor having one tooth less than said stator; a machine shaft mounted in said housing means for rotation about a fixed axis and having an end portion projecting beyond said housing means; a universal joint shaft connected at opposite ends respectively to said machine shaft and said rotor for rotation therewith and tiltable relative thereto; fluid flow control means comprising a stationary control plate and a rotary control disc both formed with central openings therethrough and both located between said machine shaft and said displacing unit, said universal joint shaft extending through the central openings in said control plate and said control disc, said control disc being provided with a plurality of control openings therethrough uniformly displaced in circumferential direction from each other and said control plate being provided with a plurality of control passages therethrough uniformly displaced in circumferential direction and cooperating with said control openings during rotation of said control disc relative to said control plate, said control openings extending in radial direction further than said control passages through a distance which corresponds to the eccentric displacement of the control disc with respect to the control plate, said control openings having lateral faces and the distance between adjacent lateral faces of adjacent control openings corresponding at least to the width in circumferential direction of the control passages.

3. An apparatus as defined in claim 2, wherein the teeth of said stator delimit with the meshing teeth of said rotor fluid displacement spaces which during rotation of the rotor relative to the stator vary between a maximum volume and a minimum volume, and wherein the control passage in the control plate located at any time in the region of a displacement space of maximum volume has a width in circumferential direction which is substantially equal to said distance of adjacent side faces of adjacent control openings in said control disc, and wherein adjacent control openings located at any time in the region of a displacement space of smallest volume are located between adjacent two side faces of adjacent control passages of the control disk in said region.

4. An apparatus as defined in claim 2, wherein the teeth of said stator delimit with the meshing teeth of the rotor fluid displacement spaces which vary during rotation of the rotor relative to the stator between a maximum volume and a minimum volume, and wherein the control passage in the control plate located at any time in the region of a displacement space of maximum volume has a width in circumferential direction which is substantially equal to the distance of adjacent side faces of adjacent control passages in said control plate, and wherein adjacent control openings located at any time in the region of a displacement space of smallest volume overlap the two control passages of the control plate in this region, said two control passages having discharge openings directed towards said rotor which are closed by the dedendums of adjacent teeth of said rotor.

5. An apparatus as defined in claim 2, wherein said housing means forms about the periphery of said control disc an annular space separated from an inner housing space through which said universal-joint shaft extends, and including fluid inlet and outlet passages respectively communicating with said annular and said inner housing spaces, said control openings of said control disc being in alternate sequence provided with radially inwardly and radially outwardly extending cutouts, said outwardly directed cutouts being arranged on the side of the control disc facing away from the control plate and having communication with said annular space of said housing, and said inwardly directed cutouts being arranged on the side of the control disc facing away from the control plate and communicating with said inner housing space.

6. An apparatus as defined in claim 5, wherein said radially outwardly and said radially inwardly extending cutouts are arranged on both sides of the control disc for a pressure relief of the latter.

7. An apparatus as defined in claim 5, and including a sealing plate connected to the side of said control disc which faces away from said control plate, said housing means being formed with a shoulder facing said sealing plate, and a support plate sandwiched between said shoulder and said sealing plate and fluid-tightly abutting against said shoulder and said sealing plate.

8. An apparatus as defined in claim 7, wherein said sealing plate is formed on the side thereof facing said support plate with an annular groove, and including a sealing ring in said annular groove.

* * * * *